United States Patent [19]

Ebeling

[11] Patent Number: 4,877,094

[45] Date of Patent: Oct. 31, 1989

[54] ROCK DRILLING MACHINE, ESPECIALLY FOR UNDERGROUND MINING

[75] Inventor: Wolfgang Ebeling, Hannover, Fed. Rep. of Germany

[73] Assignee: Turmag Turbo-Maschinen-Ag Nüsse & Gräfer, Sprockhövel, Fed. Rep. of Germany

[21] Appl. No.: 202,872

[22] Filed: Jun. 3, 1988

[30] Foreign Application Priority Data

Jun. 4, 1987 [DE] Fed. Rep. of Germany ..... 3718636

[51] Int. Cl.[4] ..... E21B 3/02

[52] U.S. Cl. ..... 175/170; 192/936; 192/85 AT; 279/4

[58] Field of Search ..... 175/170, 195, 257, 309, 175/320; 279/4 R, 20, 28; 74/160, 355, 405; 192/79, 85 AT, 93 C

[56] References Cited

U.S. PATENT DOCUMENTS

| | | | |
|---|---|---|---|
| 2,626,692 | 1/1953 | Sloan | 192/93 C |
| 2,719,620 | 10/1955 | McDonald | 192/85 AT |
| 4,019,378 | 4/1977 | Keller et al. | 279/4 R X |
| 4,319,516 | 3/1982 | Röhm | 279/4 X |
| 4,349,207 | 9/1982 | Fink | 279/4 |
| 4,566,705 | 1/1986 | Senny | 279/4 |

FOREIGN PATENT DOCUMENTS

| | | |
|---|---|---|
| 2018884 | 2/1973 | Fed. Rep. of Germany . |
| 2812096 | 4/1979 | Fed. Rep. of Germany . |

*Primary Examiner*—William P. Neuder
*Attorney, Agent, or Firm*—Michael J. Striker

[57] ABSTRACT

A rock drilling machine, particularly for underground excavations comprises a drilling carriage, and a rotary drilling drive arranged in a longitudinally displaceable manner on the drilling carriage, the rotary drilling drive having a drive shaft, an adaptor connected with the drive shaft for joint rotation therewith and having a threaded end for form-locking receipt of drilling rods with a respective counter thread, and a clamping head co-rotating with the drive shaft for force-transmitting receipt of outwardly smooth drilling rods, the adaptor being arranged forwardly of the clamping head as considered in a drilling direction, the threaded end of the adaptor extending outwardly beyond the clamping head for free observation and being releasably mounted on a part of the drive shaft independently of the clamping head.

27 Claims, 4 Drawing Sheets

ROCK DRILLING MACHINE, ESPECIALLY FOR UNDERGROUND MINING

BACKGROUND OF THE INVENTION

The present invention relates to a rock drilling machine especially for underground mining.

More particularly it relates to a rock drilling machine for underground mining which has a drilling carriage, a rotary drilling drive arranged on the drilling carriage displaceably by a displacing device and provided with a drive shaft, an adaptor fixedly connected with the drive shaft for joint rotation therewith and provided with a threaded end for form-locking receipt of drilling rods with a respective counter thread, and a clamping head which co-rotates with the drive shaft and is provided for force-transmitting receipt of outwardly smooth drilling rods.

Rock drilling machines of the above mentioned type are known in the art. One of such rock drilling machines is disclosed for example in the German document DE-AS 20 18 884. In the machine disclosed in this document the threaded end of the drive shaft is offset back relative to the clamping head for form-locking receipt of drilling rods. The threaded end of the drive shaft is engaged by the clamping heads at its both sides and therefore cannot be seen from the outside. Thereby the introduction of a drilling rod with a respective counter thread must be performed with extreme care and also by feeling, so that there is the risk that frequently the first thread turns are strained, squeezed, and deformed so that the drilling rod becomes unusable. This is true especially for the underground mining with its limited light condition.

Further, for exchange of the adaptor the whole clamping head must be dismounted, for example, when successively drilling must be performed with drilling rods of different types with different diameters and therefore different threads.

Another rock drilling machine is disclosed in the German reference DE-AS 28 12 096. This machine has a turnable carriage and a rotary drilling drive which moves along the carriage. The rotary drilling drive moves up and down by means of a rope winch as a displacement drive,along the carriage. The portion of the rope is fixed on one part and the rotary drilling drive is fixed on another part of a cylinder-piston unit. This cylinder-piston unit is provided between the engaging points of the displacement drive with pulling ropes and the carts of the rotary drilling drive. Correspondingly, with the identical downwardly directed drilling direction of this rock drilling machine, the cylinder-piston unit is formed as a single-acting and not suitable for horizontal drilling or for upwardly directed drilling. Moreover, this equalization system is suitable only for drilling machines in which the displacement drive is connected through ropes or chains with the rotary drilling drive.

Another disadvantage here is the high weight of the whole rotary drilling drive which for inserting a drilling rod must be also moved and can load the thread turns, and also the heaviness of the displacement device of the drilling machine for displacing the rotary drilling drive.

SUMMARY OF THE INVENTION

Accordingly, it is an object of the present invention to provide a rock drilling machine which avoids the disadvantages of the prior art.

More particularly, it is an object of the present invention to provide a rotary drilling machine which ensures the connection and separation of individual drilling rods with simple manipulations, with care of the rods, and in operationally safe manner, so that the service life and the insertion life of the drilling rods is increased and operational disturbances during screwing and unscrewing because of very short drilling rods are avoided.

Moreover, it is an object of the present invention to provide such a rock drilling machine which is suitable not only for downwardly directed but also for horizontal and upwardly directed drilling, and is also suitable for a fast, uncomplicated exchange of different types of drilling rods.

In keeping with these objects and with others which will become apparent hereinafter, one feature of the present invention resides, briefly stated, in a rock drilling machine in which an adaptor is arranged forwardly of a clamping head as considered in a drilling direction, its threaded end extends beyond the clamping head for a free observation and releasably mounted on a part of the drive shaft independently of the clamping head through freely accessible mounting screws or through a freely accessible surface for fitting of a screw wrench as well as through an axis-parallel thread.

When the rock drilling machine is designed in accordance with the present invention, the adaptor extends beyond the clamping head so that the screwing process between the adaptor and a drilling rod can be observed without problems and can be controlled. During conversion of an adaptor operation of the new rock drilling machine to a clamping head operation, the adaptor must be removed. This is performed through the freely accessible mounting screws or through the freely accessible surface for fitting of a screw wrench. After removal of the adaptor, the clamping head can be brought into action.

For the connection of the adaptor with the drive shaft for joint rotation therewith, two alternatives are possible. In accordance with the first advantageous embodiment of the invention the adaptor has a ring-shaped flange and is releasably connected through the flange by mounting screws with a front part of the drive shaft which is formed as a guiding ring for the clamping jaws of the clamping head. In this construction, the removal and the connection of the adaptor with the drive shaft is performed at least as fast as the removal and the fitting of a vehicle wheel.

In accordance with the second advantageous embodiment of the invention, the adaptor is provided behind its threaded end for receipt of the drilling rods as considered in the drilling direction, with at least one surface which extends beyond the clamping head and especially formed by a plurality of teeth for fitting of a wrench, and a second axis-parallel thread, to be screwed with a part of the drive shaft in a releasable and a rotary-fixed manner. In this embodiment the release and subsequent fitting of the adaptor is performed even faster, since by fitting for example a ring-shaped wrench on a free lying coupling teeth of the adaptor, the rotary drilling drive is put into operation and thereby the adaptor can either be screwed off from the driving shaft or screwed on it,- depending on the direction of rotation. Instead of the teeth, also a multi-cornered surface can be used.

This easily disassembleable and assembleable adaptor is in unfavorable conditions such as underground,of a lower disadvantage than a non-observeable adaptor or an adaptor having a worse observability in the event of a cutout clamping head. Moreover, the exchange of adaptor is significantly facilitated during the exchange of the types of the rods.

The clamping head has a plurality of radially displaceable clamping jaws which are laterally guided in cutouts of the drive shaft and provided with wedge surfaces on their rear sides for engagement of corresponding countersurfaces of a clamping ring. In accordance with an advantageous feature of the present invention, the clamping ring is displaceable in a clamping direction through an axial bearing by a ring-shaped clamping cylinder-piston unit which surrounds the drive shaft and arranged in a ring-shaped collar of a rotary drilling drive housing. The clamping cylinder-piston unit can be formed either as a ring-shaped piston which concentrically surrounds the drive shaft, or as a row of clamping cylinder-piston units which are also concentrically arranged around the drive shaft and provided with a collar of the rotary drilling drive housing which serves as a joint cylinder. In this case it is formed as clamping pistons associated with the plunger pistons.

Still a further feature of the present invention provides for a single acting clamping axial bearing and also for a single acting clamping cylinder-piston unit for example with plunger pistons. For obtaining this construction, return springs are arranged in accordance with the present invention in the segments between the clamping jaws in recesses of the clamping ring. The return springs abut against a part which is connected with the drive shaft, for example a hood or bell, or a jaw guiding ring. For bringing the clamping jaws to the open end position, the clamping ring is provided behind its front end side with grooves or openings extending over chords. Pins are mounted in the grooves or openings and engage in longitudinal grooves in the side surfaces of the clamping jaws. This return system of the clamping ring and the clamping jaws is well protected and operationally effective in any suitable drilling direction.

The conversion from one type of the rods to another type is generally connected with a change in the outer diameter of the drilling rods. For this reason a special contruction of the clamping head is associated with the adaptor.

The displacement region of the clamping jaws of this clamping head is advantageously designed so that the clamping head can engage the whole region of drilling rod diameters for such a rock drilling machine. This is insured by a long stroke of the clamping cylinder-piston unit, the clamping ring and its return springs on the one hand, and by a greater number of smaller clamping jaws, for example six clamping jaws.

In accordance with another embodiment of the clamping head with the adaptor with the ring-shaped flange, the clamping head is adapted to the exchangeable diameters of the drilling rods so that its clamping jaws can be exchanged in an especially light manner. For this purpose the ring-shaped flange with the adaptor simultaneously forms the front guiding surface of the clamping jaws, which with the removed adaptor can be slightly pulled forwardly out and other piece can be inserted. For the use of the clamping head the ring-shaped flange of the adaptor is then replaced by an end ring which laterally guides and holds the jaws. The throughgoing opening of the end ring at least corresponds to the throughgoing opening between the opened clamping jaws for passing an outwardly smooth drilling rod. For preventing unintentional dropping out of the clamping jaws with the removed adaptor or end ring, a centering ring is connected with the front part of the drive shaft. The centering ring engages from outside the flange of the adaptor or the ringshaped flange and partially overlaps the clamping jaws in their opened outlet position at an end side. During closing position, the clamping jaws can be disassembled or assembled inside the centering ring.

During screwing and unscrewing of the drilling rod with a drilling linkage fixed in a catching device, axial displacement occurs. The adaptor and selectively also the clamping head must follow this axial displacement in a forced manner to prevent damages to the thread turns on the drilling rods. Thereby a high sensitivity is required especially during screwing with the insertion of the thread turns. For this sensitivity the heavy displacement drive which is inelastic for the drilling work is very unsuitable with the high weight of the whole rotary drilling drive. In core drilling machines the clamping head must also be displaceable since during frequent subsequent insertions of the drilling rod in the drilled hole it must be pulled for screwing.

For taking into consideration these conditions, the adaptor together with the clamping head is longitudinally displaceable relative to the rotary drilling drive housing over a displacement path limited by abutment surfaces, so that also the drive shaft is supported displaceably in a drive toothed wheel and the radial-axial bearing mounted on the drive shaft with their outer rings are displaceable in a collar of the rotary drilling drive housing between two abutment surfaces. The abutment surfaces are formed in longitudinally displaceable displacement sleeve,and a cylinder of the clamping cylinder-piston unit is mounted on or abuts against the displacement sleeve.

The thus produced sum of the parts displaceable relative to the drilling drive housing can cause damages to the drilling road thread because of their weight. Moreover, the desired extended outlet position during horizontal or upwardly directed installation of the machine is not insured.

For avoiding these disadvantages, the displacement sleeve in accordance with a further embodiment of the invention forms alone or together with a cylinder of the clamping cylinder-piston unit with a collar of the rotary drilling drive housing, a double-acting differential cylinder piston unit. The latter is supplied with a pressure medium at both sides through passages in the collar. Thereby by selection of the piston side to be loaded with a pressure medium and by selection of the pressure, the weight of the displaceable parts and their friction resistance can be compensated in a desired manner.

When the displaceability of the clamping head can be dispensed with for example in large hole drilling machines, then the clamping head can be arranged non-displaceably in the collar of the rotary drilling drive housing or on the front part of the drive shaft. The drive shaft is provided with inner teeth or grooving, in which a displacement bush is non-rotatably arranged between two abutment surfaces so as to be longitudinally displaceable over a displacement path, and provided with a thread for receiving the adaptor. In this embodiment the weight of the displaceable parts is so significantly reduced that a structurally simple solution for their compensation is sufficient. Between the displacement bush and the drive shaft, at least one pressure spring is arranged. It acts so that the displacement bush of the adaptor is brought to a well-observable extended outlet position for insertion in a drilling rod thread in any position of the drilling machine.

In the latter mentioned embodiment, a drilling jetting is performed through the hollow drive shaft, the abutment and the displacement bush. The displacement bush is concealed in a pressure tight manner relative to the drive shaft at its end which faces away of the adaptor.

In the embodiment with different clamping heads the adaptor with the ring-shaped flange has a central throughgoing opening for engaging a jetting pipe. The sealing collar of the jetting pipe corresponds to the displacement path of the adaptor and is displaceable along a seal arranged in the adaptor. When this sealing must not be arranged for a relative rotary movement, the jetting pipe is provided on its outer periphery with at least one projection which is driveable in rotation by a finger. The finger is connected with the adaptor for joint rotation therewith and has a length which corresponds to the above mentioned displacement path. The jetting pipe is supported in a known manner at its rear end in a rotatable and pressure-tight manner, however, it is not longitudinally displaceable on the rotary drilling drive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
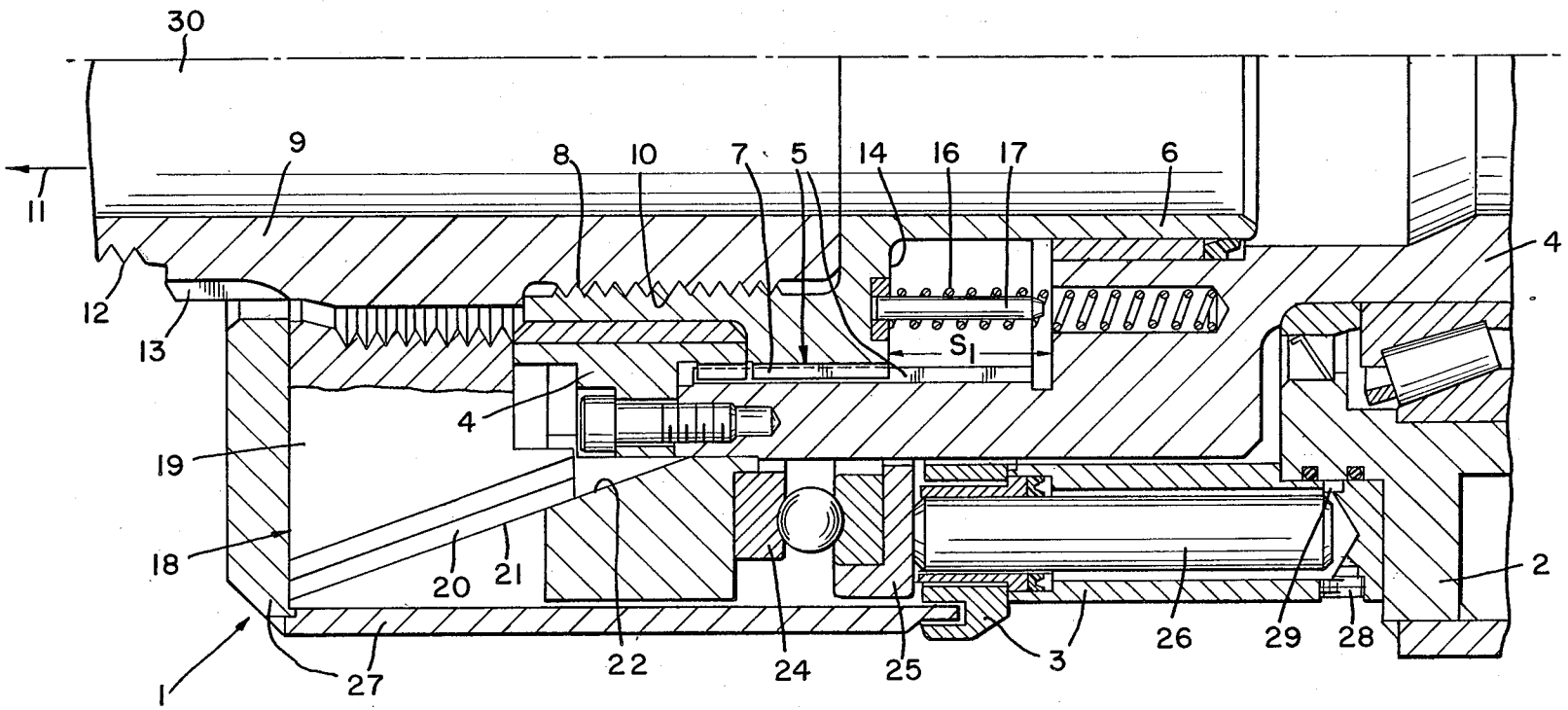
FIG 1. is a view showing one embodiment of a drive head of a rock drilling machine in accordance with the present invention, with a displaceable adaptor, and a clamping head which is not longitudinally displaceable, in a half section.

A drive head of a rock drilling machine in accordance with the present invention is identified in FIG. 1 with reference numeral 1. It has a rotary drilling drive housing 2 with a collar 3, a drive shaft 4 extending through the collar 3 and having inner teeth 5, a displacement bush 6 having outer teeth 7 which are in engagement with the inner teeth 5 so that the displacement bush 6 is driven by the drive shaft 4. The displacement bush 6 is provided with an outer thread 8. The adaptor 9 provided with a corresponding inner thread 10 engages with the outer thread 8 of the displacement bush 6 in a form-locking and force-transmitting manner. The adaptor 9 has a threaded end 12 as considered in the drilling direction identified with arrow 11. The threaded end 12 serves for form-locking receipt of a not shown drilling rod. Moreover, ring-shaped teeth 13 are provided in the vicinity of the threaded end 12 for fitting a not shown wrench.

The displacement bush 6 is supported between abutment surfaces 14 and 15 longitudinally displaceably over a displacement path $S_1$. The displacement bush 6 is arranged in a non-rotatable manner in both rotary directions relative to the drive shaft 14, due to the inner teeth 5 and the outer teeth 7.

Pressure springs 16 are guided each on a concentrically extending guiding pin 17. They displace the displacement bush 6 and thereby the adaptor 9 always in direction of the arrow 11 to a front position. Thereby the threaded end 12 is always freely observable during insertion of a drilling rod with a respective counter thread, and moreover the ring-shaped teeth 13 is always freely available for fitting of a respective wrench in the outlet position of the adaptor.

In FIG. 1 reference numeral 18 identifies a clamping head. It is composed of several symmetrically arranged, radially displaceable clamping jaws 19 which are laterally guided in cutouts of the drive shaft 4. The jaws 19 have their rear sides which surfaces 21 for engagement with respective counter surfaces 22 of a clamping ring 23.

The clamping ring 23 is displaceable in direction of the arrow 11 to a clamping position through an axial bearing 24 and a pressure ring 25 by several clamping cylinder-piston units 26 which are formed as plunger pistons. The latter are distributed uniformly over the periphery of the collars 3 of the rotary drilling drive housing 2 and arranged in an axis-parallel fashion. The plunger pistons and the collar 3 of the rotary drilling drive housing 2 together form a clamping cylinder-piston unit 3, 26.

The front part of the clamping head 18 is surrounded with a hood or bell 27. The hood 27 is mounted on the drive shaft 4 and rotates together with the latter.

The clamping jaws 19 of the clamping head 18, the clamping ring 23 and the plunger pistons of the clamping cylinder-piston units 3, 26 are withdrawn to their shown open position. Withdrawal can be performed through not shown radial and/or axial return springs in connection with known dovetail-shaped guides on the rear side 10 of the clamping jaws 19 and corresponding counter surfaces 22 of the clamping ring 23.

Figure 3:
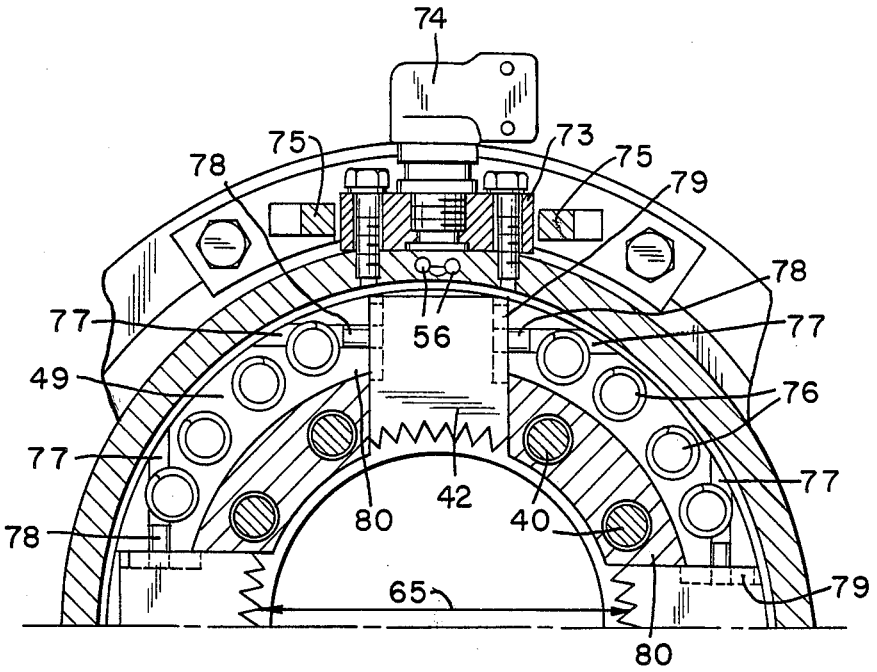
FIG. 3 is a view showing section taken through the drive head of FIG. 2 along the line III—III.

The clamping jaws 19 are entrained by longitudinal grooves on the rear sides 20 by means of pins 78 shown in FIG. 3. For clamping, the clamping cylinder-piston units 3, 26 are loaded with a pressure oil through a connection 28 and a ring-shaped passage 29. Then the plunger pistons of the clamping cylinder-piston units 3, 26 press through the pressing plate 25 and the axial bearing 24, the clamping ring 23 in direction of the arrow 11 and the clamping jaws radially inwardly to the clamping position.

The so formed drive head is especially suitable for large hole drilling machines, gas drilling machines and similar drilling machines, which operate with screwed drilling rods and jetting. The jetting is performed through a central passage 30 of the adaptor 9, a neighboring central passage of the displacement bush 6, and a subsequent central passage of the drive shaft 4. In such drilling machines it is frequently necessary, even sometimes in each bore hole, to introduce in a very short time various rod threads and rod diameters corresponding to the local conditions. This is especially the case during deep hole drilling to reduce rod portions and during gas drilling for drilling-in of stand pipes. The screwing and drilling of the rod pipes is performed with the adaptor 9 with the drilling jetting supplied through the displacement bush 6 and the drive shaft 4. The threaded end 12 of the adaptor 9 which is freely located during screwing-in in this embodiment,provides for best observation control of the screwing process which is performed with the aid of the displaceability of the adaptor 9 relative to the rotary drilling drive 2, 4 in an especially thread-fine manner.

In the event of an exchange of the drilling rod type, the adaptor 9 can be easily exchanged by means of the freely lying ring-shaped teeth 13 and the respectively formed helical wrench very easy, with application of a machine force. The clamping head 18 can engage without an exchange of the clamping jaws 19 generally all existing rod diameters, as long as the adaptor 9 is dismounted. Since the clamping head 18 during the above mentioned insertion is used only for pulling and separation of the not shown drilling rods, a longitudinal displaceability can be dispensed with. Since especially during the upwardly directed drilling the drilling jetting flows back to the drive head 1, the clamping head 18 is completely closed by the hood 27. The hood has such a shape that it is smooth from outside and does not have projecting individual parts. Therefore, it is insensitive to outside actions and especially suitable for the underground works.

Figure 1A:
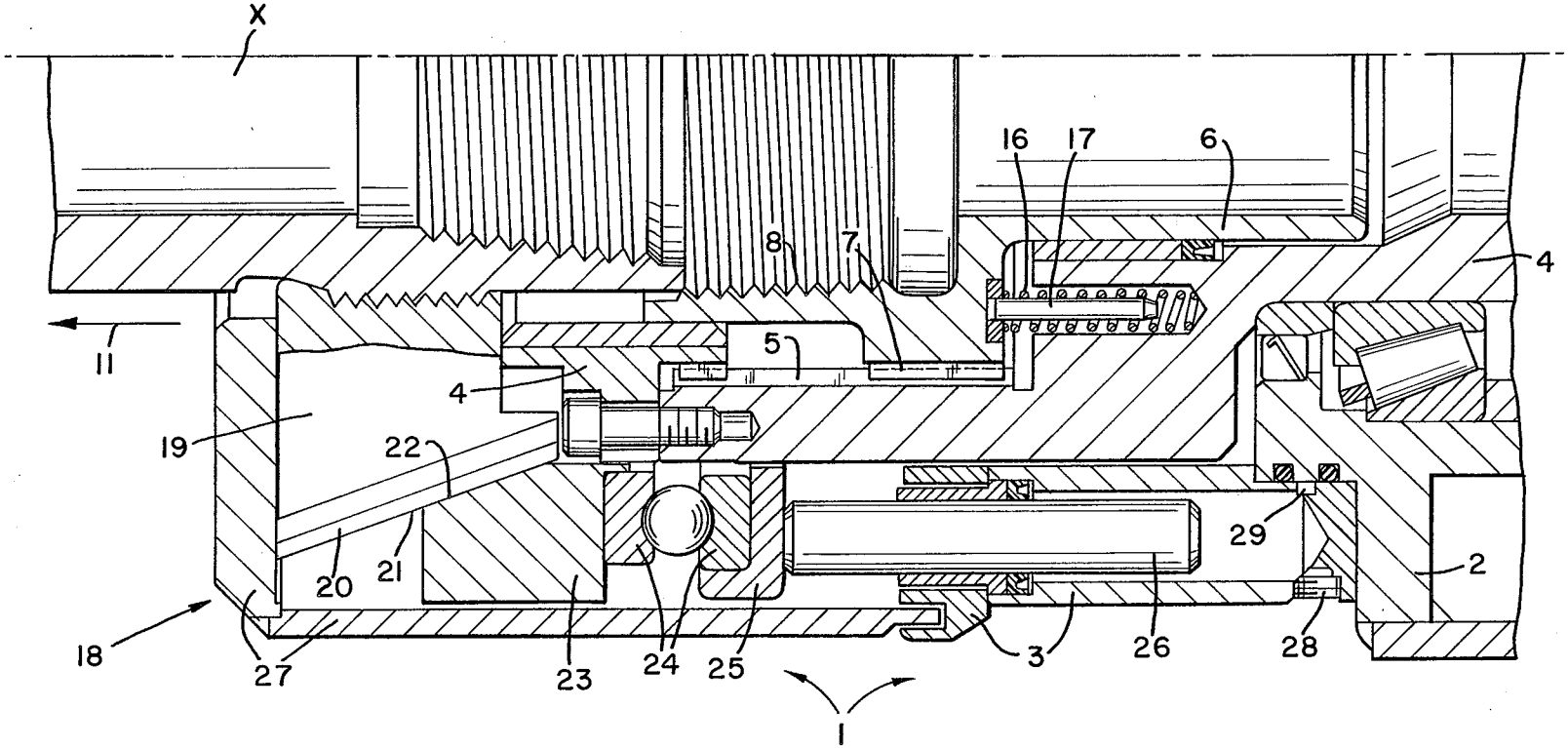
FIG 1*a* is a view showing the drive head of the rock drilling machine of FIG. 2 in another operational position.

The adaptor 9, 39 is arranged in a drilling direction 11 forwardly of a clamping head 18, 38, its threaded end 12, 43 extends beyond the clamping head 18, 38 for a free observation and releasably mounted on a part 6, 41 of the drive shaft 4, 34 independently of the clamping head 18, 38 by freely accessible mounting out of the adaptor 9, the clamping jaws 19 can engage from outside the outwardly smooth drilling X and can be used for so-called drilling rod drawing. This process is illustrated in FIG. 1*a*.

Figure 2:
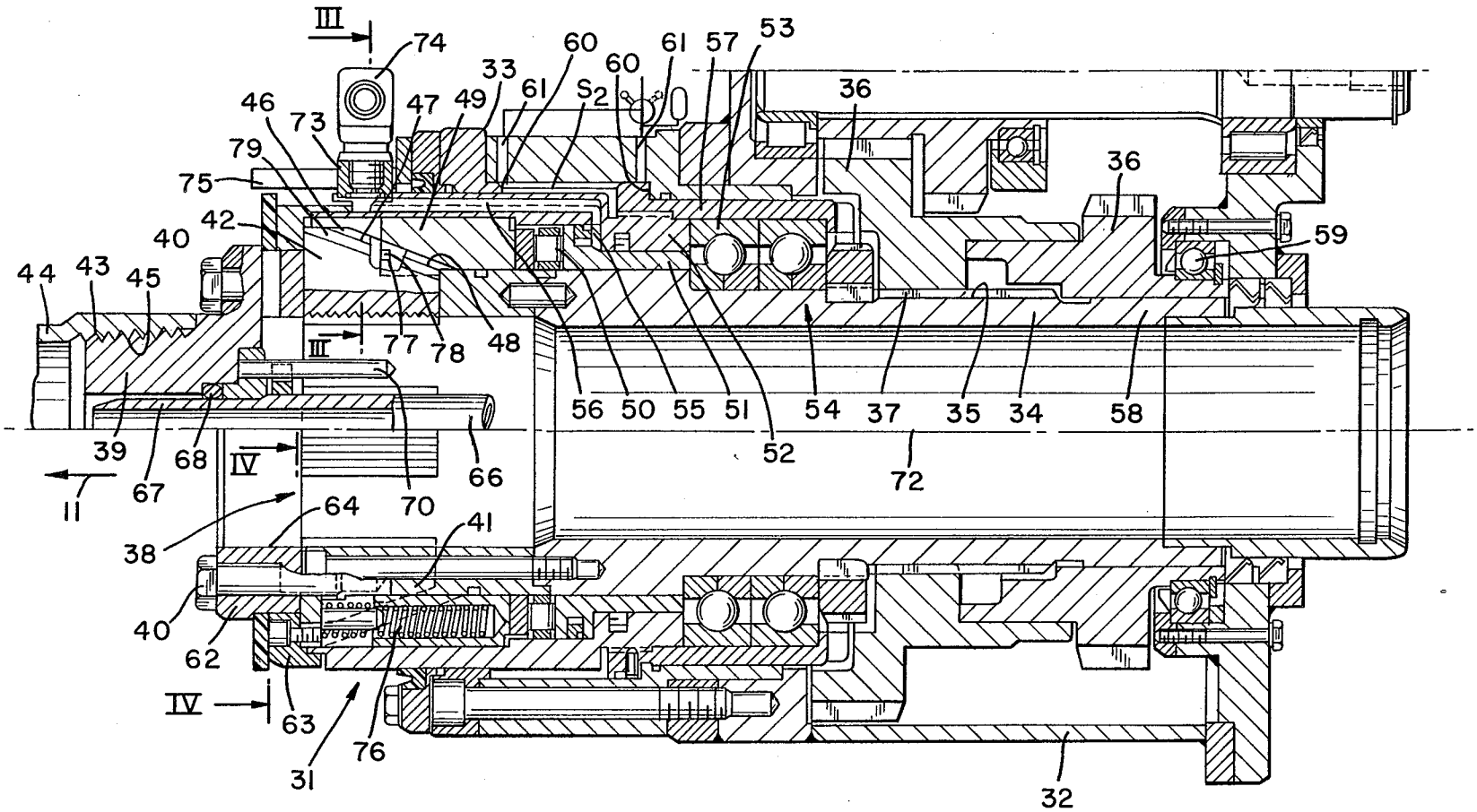
FIG. 2 a view showing a second embodiment of the drive head of the rock drilling machine in accordance with the present invention, with a longitudinally displaceable adaptor and a longitudinally displaceable clamping head.

In the embodiment of FIG. 2 a drive head 31 has not only a displaceable adaptor 39, but also an axially displaceable clamping head 38.

A rotary drilling drive housing 32 engages with its collar 33 a drive shaft 34 provided with outer teeth or a groove 35. The outer teeth 35 engage with inner teeth 37 of a drive toothed wheel 36. The adaptor 39 is releasably mounted by means of freely accessible mounting screws 40 on a guiding ring 41 for clamping jaws 42 of the clamping head 38 as a part of the drive shaft 34.

The adaptor 39 has a threaded end 43 for form-locking receipt of a drilling rod 44 with a respective counter thread 45. In addition to the abutment 39, the clamping head 38 is axially movably supported with the drive shaft 34.

In this embodiment the clamping head 38 also has several radially displaceable and laterally guided clamping jaws 42 which are arranged diametrically opposite in pairs. The clamping jaws 42 are provided on their rear sides 46 with wedge surfaces 47 for engaging respective counter surfaces 48 of a clamping ring 49. The clamping ring 49 is displaceable in a clamping direction or in other words in direction of the arrow 11 through an axial bearing 50 by a ring-shaped clamping cylinder-piston unit 51, 52 which is arranged around the drive shaft 34 in a ring-shaped collar 33 of the rotary drilling drive housing 32. The clamping cylinder 52 of the clamping cylinder-piston 51, 52 abuts against an outer ring 53 of an axial-radial bearing 54 and through the latter against the drive shaft 34. When the clamping piston 51 is loaded on its differential surface 55 through a passage 56 with a pressure oil, the clamping piston 51 is displaced and thereby also the clamping ring 49 is displaced through the axial bearing 50 in direction of the arrow 11. Thereby the clamping jaws 42 of the clamping head 38 are moved inwardly to a clamping position.

The drive shaft 34 is guided on its front part as considered in the drilling direction identified with the arrow 11, through an axial-radial bearing 54 and a displacement sleeve 57 in the collar 33 of the rotary drilling drive housing 32. It is guided in a longitudinally displaceable manner over a displacement path $S_2$. The drive shaft 34 is also displaceably guided in its rear part with its cylindrical part 58 in the drive toothed wheel 36 which in turn is guided through a bearing 59 in the rotary drilling drive housing. This longitudinal guidance is also over the same displacement path $S_2$. The outer teeth or groove 35 insure a displaceability but do not allow any mutual rotation in the inner teeth 37.

The displacement sleeve 57 alone or together with the clamping cylinder 52 mounted thereon and the collar 33 of the rotary drilling drive housing 32 surrounding the same form a double-acting differential cylinder-piston unit 33, 50, 57. It is loaded with a pressure medium through passages 61 in the collar 33.

After removal of screws 40, the adaptor 39 is exchanged with an end ring 62 and again screwed by the screw 40 with the guiding ring 41 for the jaws 42,which is mounted on the drive shaft 34. Both the adaptor and the latter mentioned guiding ring 41 are centered in a centering ring 63. The end ring 62 has a throughgoing opening 64 which is at least equal to a throughgoing opening 65 in FIG. 2 between the opened clamping jaws 42 for passing an outwardly smooth drilling rod 44. For drilling with jetting, a jetting pipe 66 is provided. It co-rotates, but does not displace longitudinally. A sealing collar 67 of the jetting pipe 66 corresponds to the displacement path $S_2$ and is displaceable along a seal 68 in the adaptor 39. A sealing flange 69 mounted on the adaptor 39 carries a finger 70 which forces the jetting pipe 66 through a driver 71 into co-rotation. In the structure for the utilization of the clamping head 31 shown under the central line 72, the jetting pipe 66 is removed since it is not needed during the use of the clamping head.

For understanding of the embodiment of FIG. 2 it is important that the machine parts 39, 41, 42, 49, 36, 63, 63 and 34 are rotatable, and the parts 39, 41, 42, 49, 62, 63, 34 are also displaceable both in direction of the arrow 11 and in an opposite direction. From the non-rotatable machine parts, the parts 51, 552, 56, 57, 73 and 74 are displaceable in direction of the arrow 11 and in an opposite direction.

The adaptor of the rock drilling machine in accordance with the present invention can be removed without demounting of other parts. This can be performed by screwing out of the adaptor 9 in the embodiment of FIG. 1, or by releasing the screw 40 in the embodiment of FIG. 2. When the adaptor has been dismounted as shown in FIG. 1*a*, displacement bush 6 performs no function. It is displaced by the drilling rod X introduced in the clamping head against the force of spring 16. The drilling rod X is engaged by the clamping jaws 19 which move toward one another under the action of the axial stroke of the piston 26 and thereby the axial bearing 24 and the clamping ring 23. In this situation the drilling rod is withdrawn from the bore hole and the drilling rod X is screwed off from the next one.

FIG. 3 shows a cross-section taken along the line III—III in FIG. 2. A connecting block 73 is screwed with the clamping cylinder 52 of the clamping cylinder-piston unit 51, 52 and communicates the pressure oil passage 56 with a conduit connector 74. The connecting block 73 is guided in a longitudinally displaceable manner in a guiding fork 75 which in turn is screwed with the collar 33 of the rotary drilling drive housing 32. Thereby the clamping cylinder-piston unit 51, 52 and also the displacement sleeve 57 are prevented from co-rotation with the drive shaft 34.

The return springs 76 are arranged in the segments between the clamping jaws 42 in blind holes of the clamping ring 49. During pressure unloading of the clamping piston 51 they displace back the clamping ring 49. The clamping jaws 42 are forcedly guided to their initial position. This forced guidance is performed through pins 78 which are pressed in transverse grooves 77, in longitudinal grooves 79 in side surfaces 80 of the clamping jaws 42. In the embodiment of of FIG. 1, it is also performed in the side surfaces of the clamping jaws 19.

Figure 4:
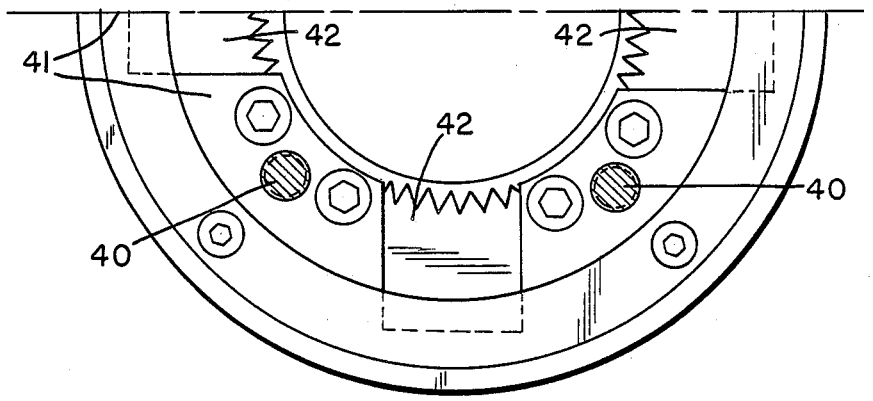
FIG. 4 is a view showing a cross-section through the drive head of FIG. 2 taken alone the line IV—IV.

FIG. 4 shows for the sake of clarity only a cross-section of the drive head 31 along the line IV—IV in FIG. 2. In the plane of this cross-section only the screws 40 are sectioned.

It will be understood that each of the elements described above, or two or more together, may also find a useful application in other types of constructions differing from the types described above.

While the invention has been illustrated and described as embodied in a rock drilling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rock drilling machine, particularly for underground excavations, comprising a drilling carriage; and a rotary drilling drive arranged in a longitudinally displaceable manner on said drilling carriage, said rotary drilling drive having a drive shaft; an adaptor connected with said drive shaft for joint rotation therewith and having a threaded end for form-locking receipt of drilling rods with a respective counter thread, and a clamping head co-rotating with said drive shaft for force-transmitting receipt of outwardly smooth drilling rods, said adaptor being arranged forwardly of said clamping head as considered in a drilling direction, said threaded end of said adaptor extending outwardly beyond said clamping head for free observation and being releasably mounted on a part of said drive shaft independently of said clamping head.

2. A rock drilling machine as defined in claim 1; and further comprising means for releasably mounting said threaded end of said adaptor on said part of said driving shaft and including freely accessible mounting screws.

3. A rock drilling machine as defined in claim 1, and further comprising means for releasably mounting said threaded end of said adaptor on said part of said driving shaft and including a freely accessible surface for fitting a wrench and an axis-parallel thread.

4. A rock drilling machine as defined in claim 1, wherein said clamping head has clamping jaws, said drive shaft having a front part which is formed as a guiding ring for said jaws, said abutment having a ring-shaped flange; and further comprising releasably connecting means and including mounting screws which connect said ring-shaped flange of said adaptor with said front part of said drive shaft.

5. A rock drilling machine as defined in claim 1, wherein said adaptor is provided with at least one surface which extends outwardly beyond said clamping head and located immediately behind said threaded end as considered in the drilling direction, said surface being formed for fitting a wrench, said adaptor being also provided with a second axis-parallel thread for connecting with said drive shaft in a releasable manner for joint rotation therewith.

6. A rock drilling machine as defined in claim 5, wherein said surface of said adaptor is formed as a plurality of teeth.

7. A rock drilling machine as defined in claim 1, wherein said drive shaft has a plurality of cutouts, said clamping head having several radially displaceable clamping jaws which are guided through said cutouts of said drive shaft and having the rear side provided with wedge surfaces, said clamping head including a clamping ring which has countersurfaces engaging with said wedge surfaces of said clamping jaws; and further comprising an axial bearing, said clamping ring being displaceable through said axial bearing in a clamping direction.

8. A rock drilling machine as defined in claim 7; and further comprising a rotary drilling drive housing having a ring-shaped collar; and means for displacing said clamping ring and including a clamping cylinder-piston unit which is arranged in a ring-shaped manner around said drive shaft in said collar of said housing.

9. A rock drilling machine as defined in claim 8, wherein said clamping ring of said clamping head has segments provided between said clamping jaws and forming receiving spaces; and further comprising return springs arranged in said receiving spaces.

10. A rock drilling machine as defined in claim 1; and further comprising a rotary drilling drive housing having a collar and abutment surfaces defining a displacement path $S_2$; a displacement sleeve longitudinally displaceable in said collar of said housing between said abutment surfaces; a radial-axial bearing mounted on said drive shaft and having outer rings, said adaptor together with said clamping head being displaceable longitudinally relative to said housing over said displacement path $S_2$ limited by said abutment surfaces so that said drive shaft is displaceably supported in a drive toothed wheel and said radial-axial bearing mounted on said drive shaft is guided with said outer rings in said displacement sleeve; and a clamping cylinder-piston unit having a cylinder cooperating with said displacement sleeve.

11. A rock drilling machine as defined in claim 10, wherein said cylinder of said clamping cylinder-piston unit is mounted on said displacement sleeve.

12. A rock drilling machine as defined in claim 10, wherein said cylinder of said clamping cylinder-piston unit is supported on said displacement sleeve.

13. A rock drilling machine as defined in claim 10, wherein said collar of said housing has passages for supplying a pressure medium, said displacement sleeve forming a double-acting differential cylinder-piston unit supplied with the pressure medium through said passages in said collar.

14. A rock drilling machine as defined in claim 10, wherein said collar of said housing has passages for supplying a pressure medium, said displacement sleeve together with said cylinder of said clamping cylinder-piston unit and with said sleeve which surrounds the latter form a double-acting differential cylinder-piston unit which is supplied with the pressure medium through said passages in said collar.

15. A rock drilling machine as defined in claim 1, wherein said clamping head has clamping jaws which in their open condition form a throughgoing opening for passing an outwardly smooth drilling rod, said drive shaft having a front part, said adaptor being removable; and further comprising an end ring arranged to be screwed on said front part of said drive shaft upon removal of said adaptor, and having a throughgoing opening which is at least equal to said throughgoing opening between said clamping jaws.

16. A rock drilling machine as defined in claim 15, wherein said adaptor has a surface which faces said clamping jaws and forms a front guiding surfaces for said clamping jaws.

17. A rock drilling machine as defined in claim 15, wherein said end ring has a surface which faces toward said clamping jaws and forms a front guiding surface for said clamping jaws.

18. A rock drilling machine as defined in claim 15, wherein said clamping jaws have a front end side; and further comprising a centering ring which surrounds said adaptor and is mounted on the front part of said drive shaft, said centering ring partially overlapping said front end side of said clamping jaws in an open condition of the latter.

19. A rock drilling machine as defined in claim 15, wherein said clamping jaws have a front end side; and further comprising a centering ring which surrounds said end ring and is mounted on the front part of said drive shaft, said centering ring partially overlapping said front end side of said clamping jaws in an open condition of the latter.

20. A rock drilling machine as defined in claim 1, wherein said clamping head is arranged in a not longitudinally displaceable manner, said drive shaft having an inner engaging formation; and further comprising a displacement bush which is arranged non-rotatable relative to said drive shaft and longitudinally displaces in said inner formation between two abutment surfaces over a displacement path $S_1$, said displacement bush having a thread and said adaptor having a counter thread engageable with one another so that said displacement bush receives said adaptor.

21. A rock drilling machine as defined in claim 20; and further comprising a rotary drilling drive housing having a collar, said clamping head being arranged in a longitudinally non-displaceable manner in said collar of said housing.

22. A rock drilling machine as defined in claim 20, wherein said drive shaft has a front part, said clamping head being arranged in a longitudinally non-displaceable manner in said front part of said drive shaft.

23. A rock drilling machine as defined in claim 20, wherein said inner engaging formation of said drive shaft is formed as a plurality of inner teeth.

24. A rock drilling machine as defined in claim 20, wherein said inner engaging formation of said drive shaft is formed as grooving.

25. A rock drilling machine as defined in claim 20; and further comprising a pressure spring arranged between said displacement bush and said drive shaft in an axis-parallel manner.

26. A rock drilling machine as defined in claim 1, wherein said adaptor is displaceable over a limited displacement path $S_2$ and has a central throughgoing opening, said adaptor being also provided with a seal; and further comprising a jetting pipe extending through said central throughgoing opening of said adaptor and having a sealing collar which corresponds to said displacement path and is displaceable along said seal of said adaptor.

27. A rock drilling machine as defined in claim 26; and further comprising a finger which is connected with said abutment for joint rotation therewith and has a length which corresponds to said displacement path, said jetting pipe having an outer periphery provided with at least one projection which is engageable by said finger for driving in a rotary direction.

* * * * *